US006262530B1

(12) United States Patent
Prein

(10) Patent No.: US 6,262,530 B1
(45) Date of Patent: Jul. 17, 2001

(54) FIELD EMISSION DEVICES WITH CURRENT STABILIZER(S)

(76) Inventor: Ivan V. Prein, 12300 Hymeadow #112, Austin, TX (US) 78750

( * ) Notice: Subject to any disclaimer, the term of this patent is extended or adjusted under 35 U.S.C. 154(b) by 0 days.

(21) Appl. No.: 09/060,359

(22) Filed: Apr. 15, 1998

Related U.S. Application Data

(60) Provisional application No. 60/038,506, filed on Feb. 25, 1997, and provisional application No. 60/044,471, filed on Apr. 18, 1997.

(51) Int. Cl.[7] ..... H01J 1/304; H01J 19/24

(52) U.S. Cl. ..... 313/497; 313/496; 313/307

(58) Field of Search ..... 313/309, 351, 313/306, 307, 308, 496, 497

(56) References Cited

U.S. PATENT DOCUMENTS

| | | | | |
|---|---|---|---|---|
| 4,940,916 | * | 7/1990 | Borel et al. | 313/306 |
| 5,214,347 | | 5/1993 | Gzezy . | |
| 5,283,500 | * | 2/1994 | Kochanski | 313/336 |
| 5,382,867 | * | 1/1995 | Maruo et al. | 313/309 |
| 5,386,172 | * | 1/1995 | Komatsu | 313/309 |
| 5,466,982 | * | 11/1995 | Akinwande | 313/309 |
| 5,502,348 | * | 3/1996 | Moyer et al. | 313/306 |
| 5,610,471 | * | 3/1997 | Bandy et al. | 313/309 |
| 5,644,188 | * | 7/1997 | Potter | 313/309 |
| 5,646,479 | * | 7/1997 | Troxell | 313/495 |
| 5,679,960 | * | 10/1997 | Akama | 313/309 |
| 5,691,600 | * | 11/1997 | Moyer et al. | 313/497 |
| 5,804,909 | * | 9/1998 | Nilsson et al. | 313/309 |
| 5,859,493 | * | 1/1999 | Kim | 313/309 |

FOREIGN PATENT DOCUMENTS 0681 311 A1 8/1995 (EP) .

* cited by examiner

*Primary Examiner*—Michael H. Day

(57) ABSTRACT

A field emission device includes a non-stabilized special vector electron source having a field emission edge emitter cathode (102), a stabilizing anode (103) and a current stabilizer (104) in electrical circuit of the stabilizing anode (103), a collecting anode (105) and at least one control electrode (106) for controlling emission flow of electrons from the vector electron source to the collecting anode (105).

4 Claims, 13 Drawing Sheets

FIELD EMISSION DEVICES WITH CURRENT STABILIZER(S)

This application claims benefit of Provisional Application Ser. No. 60/038,506 filed Feb. 25, 1997, also Ser. No. 60/044,471 filed Apr. 18, 1997.

FIELD OF THE INVENTION

This invention relates generally to field emission devices.

BACKGROUND OF THE INVENTION

Cold cathode field emission devices (FEDs) are known in the art. FEDs typically comprise an electron emitter, for emitting electrons and an extraction electrode, for providing an electric field to the electron emitter to facilitate the emission of electrons. FEDs may also include an anode for collecting emitted electrons.

Operation of FEDs usually includes operable coupling a voltage between the extraction electrode and a reference potential and operable connecting the electron emitter to the reference potential. Alternatively, the extraction electrode may be operable coupled between the electron emitter and the reference potential. In order to effect modulated electron emission it is possible to provide an extraction electrode potential in concert with a variable electron emitter potential.

A common operational shortcoming of FEDs is that the electron emission occurs during the period of application of modulating signals only. Attempts to overcome this shortcoming have not been operationally enabling.

Accordingly, a need exists for a method of operating electron's emission independing in parts or all from technical date of field emission cathodes and enabling to operate flow of electrons in vacuum.

Field emission vacuum microtubes are also known. Vacuum tube technology typically relied upon electron emission as induced through provision of a heated cathode. More recently, solid-state devices have been proposed wherein electron emission activity occurs in conjunction with a cold cathode. The advantages of the latter technology are significant, and include rapid switching capabilities and resistance to electromagnetic pulse phenomena.

Flat panel field emission displays are also known in the art. The displays typically include electron emitters emitting electrons, extraction electrodes, proximally disposed with respect to the electron emitters, and anodes for collecting at least some of any emitted electrons with a layer of cathodoluminescent material (phosphor) that is deposited on the back side of the viewing area of the display.

Notwithstanding the anticipated advantages of solid-state field emission devices, a number of problems are currently faced that inhibit wide spread application of this technology. One problem relates to unable manufacturability of such devices. Current non-planar configurations for these devices require the construction, at a microscopic level, of emitter cones, through a layer by layer deposition process, is proving a significant challenge to today's manufacturing capability. Planar configured devices have also been suggested, which devices will apparently be significantly easier to manufacture. Such planar configurations, however, will not necessarily be suited for all hoped for applications.

Accordingly, a need exists for the FEDs that can be readily manufactured using known manufacturing techniques, and that yields the devices suitable for application in a variety of uses. Fabrication of the FEDs is also known and has, in general, led to nonuniform geometry of individual emitting cathodes in device arrays. Since electron emission is from the emitting cathodes, the non-uniform geometry of the individual emitting cathode typically causes non-uniform emission of electrons and, hence destruction of emitting cathodes that emit excess electrons.

There is a need for method that provides for minimizing non-uniform electron emission from emitting cathodes.

SUMMARY OF THE INVENTION

These needs and others are substantially met through provision method operating of the field emission emitting cathodes, design and fabricate of the field emission devices based on this the method disclosed herein.

Field emission devices constructed in accordance with invitation include generally a cathode emitting electrons, a stabilizing anode, a current stabilizer and a collecting anode. The method allows fabricating multiple the emitting cathodes, the stabilizing anodes, the stabilizers, the control electrodes and the collecting anodes for a field emission device. The method, offered basic field emission devices and technique of fabricate these in accordance with invitation allow minimize non-uniform electron emission from emitting cathodes by resistance elements between each or group cathodes and electrodes. This also allows designing field emission devices without control electrode for simple using.

Field emission devices in accordance with invitation can fabricate by using simple known planar technologies.

Using this technique allows producing the field emission devices on base substrate together with solid-state electronics devices.

The method allows use field emission cold cathode in termoelectronics mode.

The method allows minimize non-uniform field emission from cathodes in case damage parts of all in working time or their non-uniform fabricating.

DETAILED DESCRIPTION OF A PREFERRED EMBODIMENT

Figure 1:
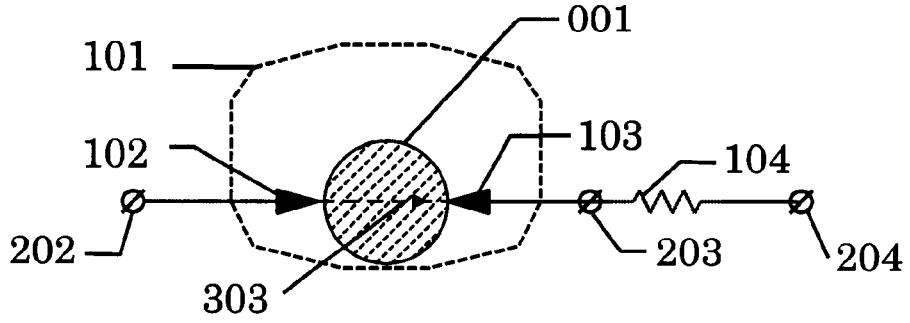
FIG. 1 is a schematic representation of an edge emitter non-stabilized spatial vector electron source.

FIG. 1 illustrates a schematic representation of an edge emitter non-stabilized spatial vector electron source wherein a field emission cathode 102 emits electrons in direction of a stabilizing anode 103 by electrical field effect between the stabilizing anode 103 and the field emission cathode 102. The electrical field is provided by different voltage between the stabilizing anode 103 and the field emission cathode 102. The field emission cathode 102 has a conductive electrode 202 and may be used for operating. The stabilizing anode 103 has conductive electrode 203 to connect to a current stabilizer 104. The main operating condition of the spatial vector electron source as a non-stabilized spatial vector electron source is presence of the current stabilizer 104 emplaced into circuit between electrode 203 of the stabilizing anode 103 and electrode 204 to connect to a voltage source of the stabilizing anode 103. In the most cases the function of the current stabilizer 104 may be performed by resistive element that is used in the solid-state electronics for building voltage stabilizers by using zener diode and resistor. The field emission effect is possible by a condition emplacement of the emitting cathode 102 and the stabilizing anode 103 in high vacuum 101. The space 303 between the emitting cathode 102 and the stabilizing anode 103 is the non-stabilized electron source 001 in vacuum 101.

Figure 2:
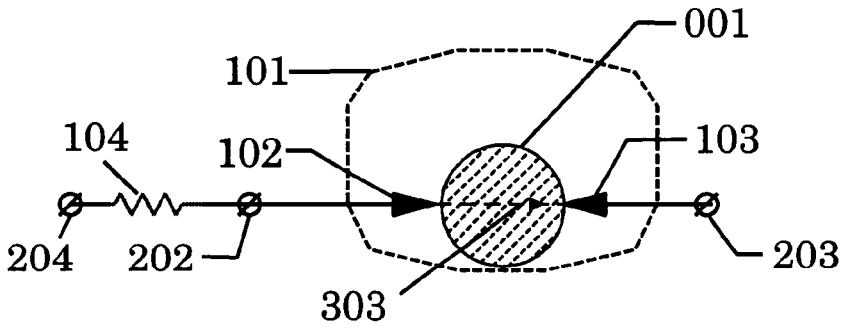
FIG. 2 is a schematic representation of an edge emitter stabilized spatial vector electron source.

FIG. 2 illustrates a schematic representation of an edge emitter stabilized spatial vector electron source wherein a field emission cathode 102 emits electrons in direction of a stabilizing anode 103 by electrical field effect between the stabilizing anode 103 and the field emission cathode 102. The electrical field is provided by different voltage between the stabilizing anode 103 and the field emission cathode 102. The field emission cathode 102 has a conductive electrode 202 to connect to a current stabilizer 104 and may be used for operating. The stabilizing anode 103 has conductive electrode 203 for operating. The main operating condition of the spatial vector electron source as a stabilized spatial vector electron source is presence of the current stabilizer 104 emplaced into circuit between electrode 202 of the emitting cathode 102 and electrode 204 to connect to voltage source of the emitting cathode 102. In the most cases the function of the current stabilizer 104 may performed by resistive elements how it is used in the solid-state electronics for building voltage stabilizers by using zener diode and resistor. The field emission effect is possible by condition emplacement of the emitting cathode 102 and the stabilized anode 103 in high vacuum 101. The space between the emitting cathode 102 and the stabilizing anode 103 is the stabilized electron source 001 in vacuum 101.

Figure 3:
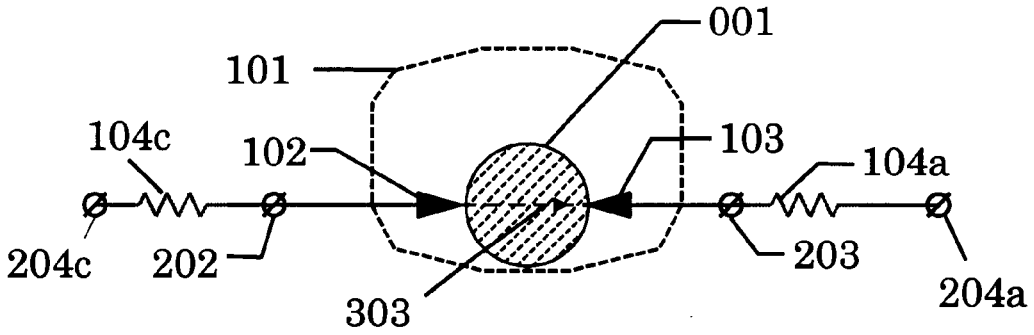
FIG. 3 is a schematic representation of an edge emitter limited spatial vector electron source.

FIG. 3 illustrates a schematic representation of an edge emitter limited spatial vector electron source wherein a field emission cathode 102 emits electrons in direction of a stabilizing anode 103 by electrical field effect between the stabilizing anode 103 and the field emission cathode 102. The electrical field is provided by different voltage between the stabilizing anode 103 and the field emission cathode 102. The field emission cathode 102 has a conductive electrode 202 to connect to a cathode current stabilizer 104*c* and also may be used for operating. The stabilizing anode 103 has conductive electrode 203 to connect to an anode current stabilizer 104*a* and also may be used for operating. The main operating condition of the spatial vector electron source as a limited spatial vector electron source is presence the anode current stabilizer 104*a* emplaced into circuit between the electrode 203 of the stabilized anode 103 and the electrode 204*a* connecting to a voltage source of the stabilizing anode 103 and also the cathode current stabilizer 104*c* emplaced in circuit between the electrode 202 of the emitting cathode 102 and the electrode 204*c* connecting to voltage source of the emitting cathode 102. In the most cases the function of the stabilizers of current 104*a* and 104*c* may perform by resistive elements how it is made in the solid-state electronics for building voltage stabilizers by using zener diode and resistor. The field emission effect is possible by condition emplacement the emitting cathode 102 and the stabilized anode 103 in high vacuum 101. The space between the emitting cathode 102 and the stabilizing anode 103 is the limited electron source 001 in vacuum 101.

Figure 4:
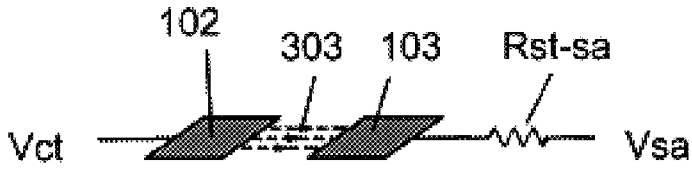
FIG. 4 is a schematic view showing a first embodiment of an edge emitter spatial vector electron source.

FIG. 4 is a schematic view showing a first embodiment of an edge emitter spatial vector electron source. The first embodiment of the edge emitter spatial vector electron source is a non-stabilized spatial vector electron source comprising: an edge emitter cathode 102, a stabilizing anode 103 and a resistive element Rst-sa stabilizing a current of the stabilizing anode 103.

Figure 5:
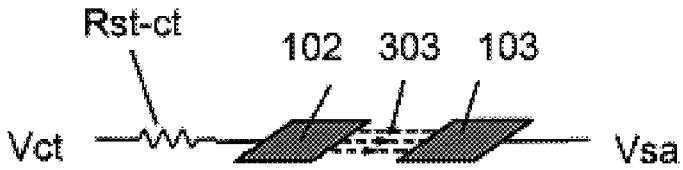
FIG. 5 is a schematic view showing a second embodiment of an edge emitter spatial vector electron source.

FIG. 5 is a schematic view showing a second embodiment of an edge emitter spatial vector electron source. The second embodiment of the edge emitter spatial vector electron source is a stabilized spatial vector electron source that comprises: a resistive element Rst-ct stabilizing a current of the cathode 102, an edge emitter cathode 102 and a stabilizing anode 103.

Figure 6:
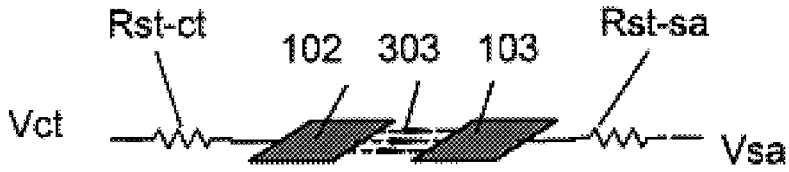
FIG. 6 is a schematic view showing a third embodiment of an edge emitter spatial vector electron source.

FIG. 6 is a schematic view showing a third embodiment of an edge emitter spatial vector electron source. The third embodiment of the edge emitter spatial vector electron source is a limited spatial vector electron source comprising: a resistive element Rst-ct stabilizing current of the cathode 102, an edge emitter type cathode 102, a stabilizing anode 103 and a resistive element Rst-sa stabilizing current of the stabilizing anode 103.

Figure 7:
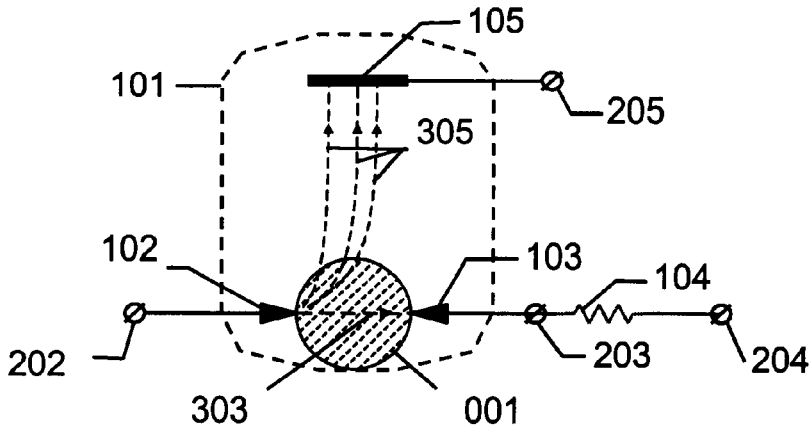
FIG. 7 is a schematic representation of a field emission triode type device employing an edge emitter non-stabilized spatial vector electron source.

FIG. 7 illustrates a schematic representation of a field emission triode type device employing an edge emitter non-stabilized spatial vector electron source wherein electrons 305 of the spatial vector electron source 001 may be directed to collecting anode 105 by turning of electrical field vector for electrons 303 emitting by a cathode 102 in direction of a stabilizing anode 103. The field emission effect is possible by condition emplacement the emitting cathode 102, the stabilized anode 103 and the collecting anode 105 in high vacuum 101. Electrodes 202, 203, 204 and 205 allow designing variety field emission devices based on the field emission triode type device employing the non-stabilized spatial vector electron source.

Figure 8:
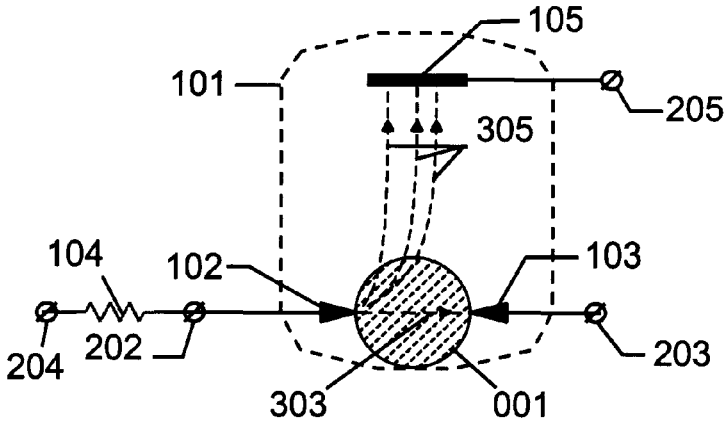
FIG. 8 is a schematic representation of a field emission triode type device employing an edge emitter stabilized spatial vector electron source.

FIG. 8 illustrates a schematic representation of a field emission triode type device employing an edge emitter stabilized spatial vector electron source wherein electrons 305 of the spatial vector electron source 001 may be directed to collecting anode 105 by turning of electrical field vector for electrons 303 emitting by a cathode 102 in direction of a stabilizing anode 103. The electrodes 202, 203, 204 and 205 allow designing variety field emission devices based on the field emission triode type device employing the stabilized spatial vector electron source.

Figure 9:
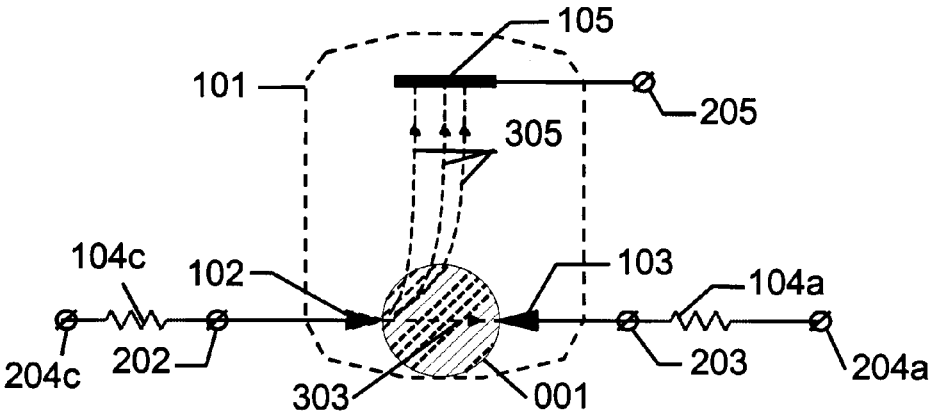
FIG. 9 is a schematic representation of a field emission triode type device employing an edge emitter limited spatial vector electron source.

FIG. 9 illustrates a schematic representation of a field emission triode type device employing an edge emitter limited spatial vector electron source wherein electrons 305 of the spatial vector electron source 001 may be directed to collecting anode 105 by turning of electrical field vector for electrons 303 emitting by a cathode 102 in direction of a stabilizing anode 103. The electrodes 202, 203, 204*a*, 204*c* and 205 allow designing variety field emission devices based on the field emission triode type device employing the limited spatial vector electron source.

Figure 10:
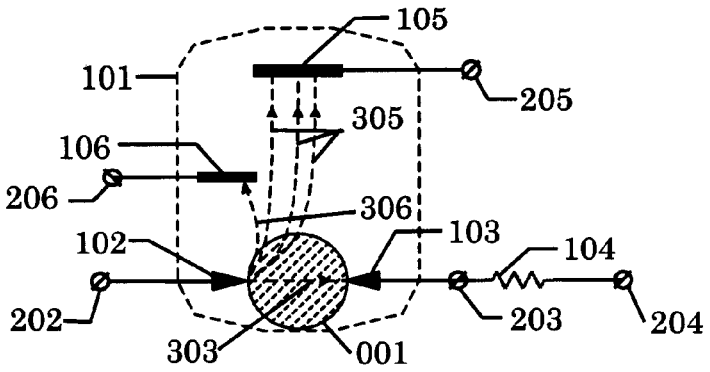
FIG. 10 is a schematic representation of a field emission tetrode type device employing an edge emitter non-stabilized spatial vector electron source.

FIG. 10 illustrates a schematic representation of a field emission tetrode type device employing an edge emitter non-stabilized spatial vector electron source wherein electrons 305 of the spatial vector electron source 001 may be directed to collecting anode 105 and electrons 306 to an control electrode 106 by turning of electrical field vector for electrons 303 emitting by a cathode 102 in direction of a stabilizing anode 103. The electrodes 202, 203, 204, 205 and 206 allow designing variety field emission devices based on the field emission tetrode type device employing the non-stabilized spatial vector electron source.

Figure 11:
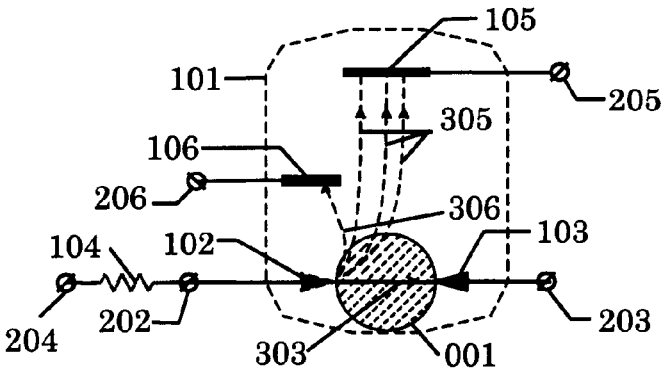
FIG. 11 is a schematic representation of a field emission tetrode type device employing an edge emitter stabilized spatial vector electron source.

FIG. 11 illustrates a schematic representation of a field emission tetrode type device employing an edge emitter stabilized spatial vector electron source wherein electrons 305 of the spatial vector electron source 001 may be directed to collecting anode 105 and electrons 306 to an control electrode 106 by turning of electrical field vector for electrons 303 emitting by a cathode 102 in direction of a stabilizing anode 103. The electrodes 202, 203, 204, 205 and 206 allow designing variety field emission devices based on the field emission tetrode type device employing the stabilized spatial vector electron source.

Figure 12:
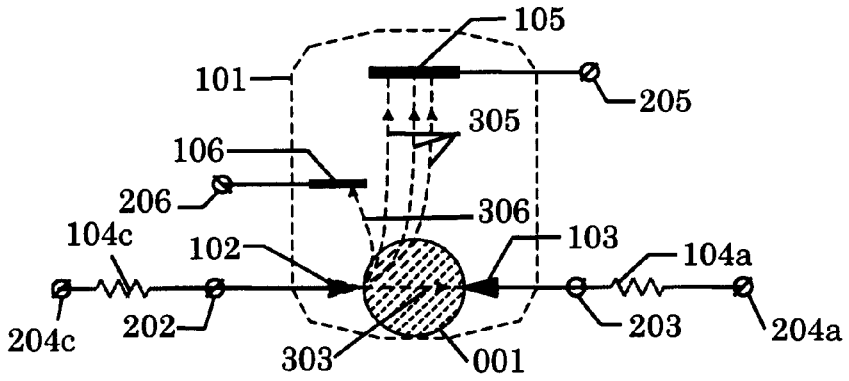
FIG. 12 is a schematic representation of a field emission tetrode type device employing an edge emitter limited spatial vector electron source.

FIG. 12 illustrates a schematic representation of a field emission tetrode type device employing an edge emitter limited spatial vector electron source wherein electrons 305 of the spatial vector electron source 001 may be directed to collecting anode 105 and electrons 306 to an control electrode 106 by turning of electrical field vector for electrons 303 emitting by a cathode 102 in direction of a stabilizing anode 103. The electrodes 202, 203, 204*a*, 204*c*, 205 and 206 allow designing variety field emission devices based on the field emission tetrode type device employing the limited spatial vector electron source.

Figure 13:
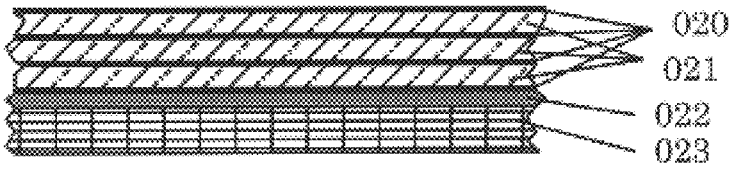
FIG. 13 is a transverse cross section of the basic laminate structure to produce edge emitter field emission devices employing spatial vector electron sources.

FIG. 13 illustrates a example of a side elevational sectioned view of a substrate fabricating field emission devices employing edge emitter spatial vector electron sources therein a substrate 023 has the sandwich design comprising: several layers 022 of circuits based on solid-state electronics; several conductive layers 020 including cathodes, anodes, passive components and electrodes; dielectric layers 020. A simple planar method to fabricate the sandwich design comprises following known technological procedures: deposition needed quantity dielectric, conductive and photoresist layers, selective exposition and development of photoresist layers, etching processes selectively to remove deposited layers.

Figure 14:
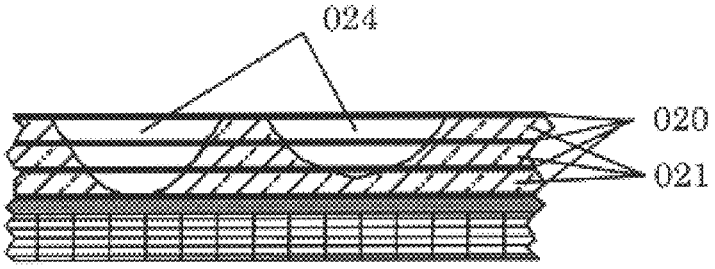
FIG. 14 is a cross section of the substrate referred in FIG. 13 with selectively formed cavities.

FIG. 14 illustrates an example of a side elevational sectioned view of a substrate shown in FIG. 13 within is selectively formed cavities 024 by etching processes into dielectric 021 through holes in conductive layers 020. Thereby after cavities 024 are formed sandwich design for fabricating field emission devices employing edge emitter spatial vector electron sources is produced.

Figure 15:
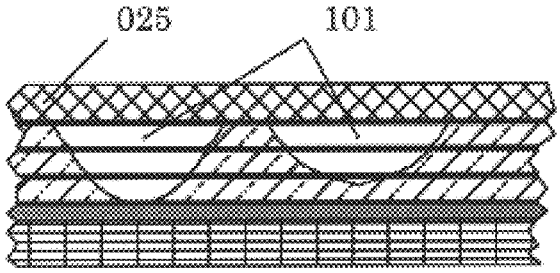
FIG. 15 is a cross section of the substrate referred in FIG. 13 with cavities.

FIG. 15 illustrates an example of a side elevational sectioned view of a substrate shown in FIG. 14 with finished sandwich design for fabricating field emission devices with edge emitter spatial vector electron sources, within a dielectric layer 025 covers field emission device. Thereby after deposition the dielectric layer 025 the field emission device employing spatial vector electron sources is produced.

Figure 16:
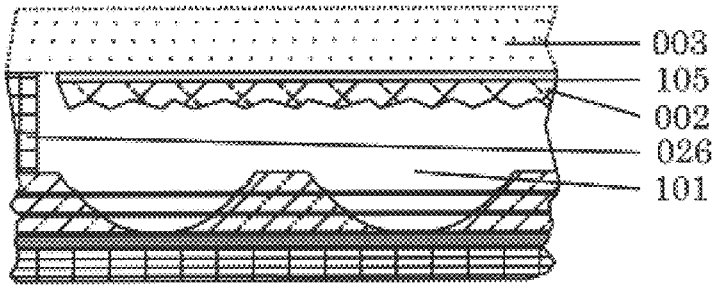
FIG. 16 is a cross section of a field emission display.

FIG. 16 illustrates an example of a side elevational-sectioned view of a substrate shown in FIG. 14 with ended sandwich design for fabricating field emission devices employing edge emitter spatial vector electron sources and an upper sandwich design of the field emission display. The upper sandwich design of the field emission display comprises a transparent collecting anode 105, a cathodoluminescent material 002 and a transparent upper plate 003. Spacers 026 divide the sandwich design and upper sandwich design.

Figure 17:
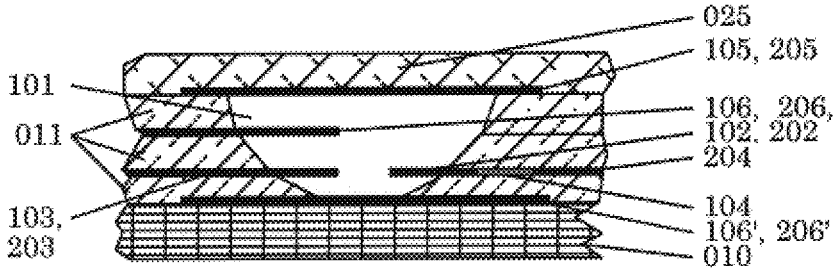
FIG. 17 is a cross section of a tetrode type field emission device employing an edge emitter stabilized spatial vector electron source.

FIG. 17 illustrates an example of a side elevational-sectioned view of a field emission tetrode type device with a negative and positive control electrodes based on an edge emitter stabilized spatial vector electron source. The field emission tetrode type device comprises a substrate 010; a first conductive layer including the negative control electrode 106' and electrode 206' of the control anode; a second conductive layer including an emitting cathode 102, a stabilizing anode 103, a stabilizer of current of the cathode (planar resistive element) 104, an electrode 202 of the emitting cathode, an electrode 203 of the stabilizing anode and an electrode 204 of the stabilizer of current of the emitting cathode; a third conductive layer including the positive control electrode 106, an electrode 206 of the control anode; a forth conductive layer including an collecting anode 105 and an electrode 205 of the collecting anode; dielectric layers 011 dividing the conductive layers; and a dielectric layer 025.

Figure 18:
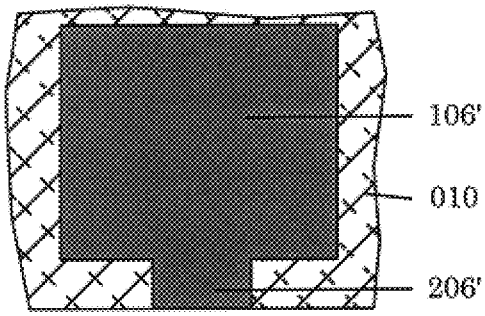
FIG. 18 is a view of a first conductive layer of an edge emitter tetrode field emission device referred in FIG. 17.

FIG. 18 illustrates an example of view of first conductive layer of the field emission tetrode type device shown in FIG. 17 therein on substrate 010 made a negative control electrode 106' and an electrode of the anode 206' by well known prior technique.

Figure 19:
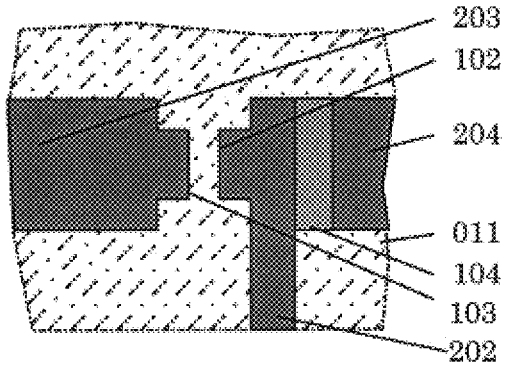
FIG. 19 is a view of a second conductive layer of an edge emitter tetrode type field emission device referred in FIG. 17.

FIG. 19 illustrates an example view of second conductive layer of the field emission tetrode type device referred in FIG. 17 therein on dielectric 011 deposited an emitting cathode 102, a stabilizing anode 103, a stabilizer of current of the emitting cathode (planar resistive element) 104, an electrode 202 of the emitting cathode, an electrode 203 of the stabilizing anode and an electrode 204 of the current stabilizer of the emitting cathode by well known prior technique.

Figure 20:
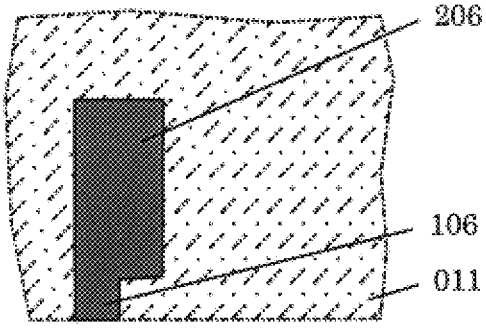
FIG. 20 is a view of a third conductive layer of an edge emitter tetrode type field emission device referred in FIG. 17

FIG. 20 illustrates an example view of third conductive layer of the field emission tetrode type device referred in FIG. 17 therein on dielectric 011 deposited a first positive control electrode 106, a second positive control electrode 106", an electrode 206 of the first control anode and an electrode 206" of the second control anode by well known prior technique.

Figure 21:
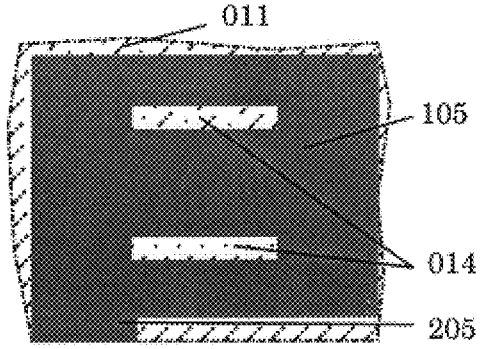
FIG. 21 is a view of forth-conductive layer of an edge emitter tetrode type field emission device referred in FIG. 17.
Figure 22:
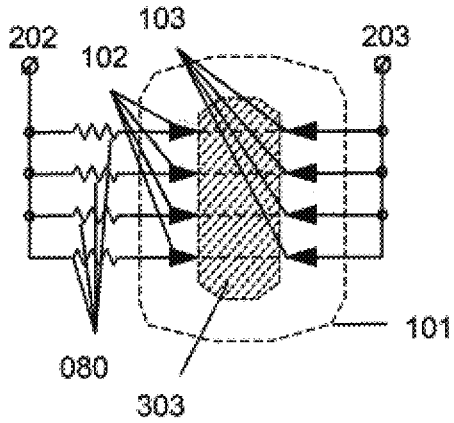
FIG. 22 is a schematic view showing an edge emitter spatial vector electron source having multiple cathodes.

FIG. 21 illustrates an example view of forth conductive layer of the field emission tetrode type device referred in FIG. 17 therein on dielectric 011 deposited an collecting anode 105 and an electrode 205 of the collecting anode by well known prior technique. The collecting anode 105 has holes 014 to form a cavity by well-known prior etching technique FIG. 22 illustrates a case of multiplicity fabricating of an emitting cathode 102 of edge emitter spatial vector electron sources. The multiplicity fabricating of the emitting cathode 102 provides increasing of a current of the emitting cathode 102. In this case, because of technological tolerance, the emitting cathodes 102 may have different currents from different cathodes 102 for one the spatial vector electron source 303 for equally voltage between the stabilized anode 103 and the each discrete emitting cathode 102. For current aligning of different emitting cathodes 102 circuits between the each discrete emitting cathode 102 and a collective electrode 202 may include an aligning resistive element 080. Electrodes of the emitting cathode 202 and the stabilizing anode 203 in this case perform function as it is for the one emitting cathode 102. The resistive elements 080 may perform part or full a functionality of a current stabilizer 104 shown in FIG. 2 or a current stabilizer 104*c* shown in FIG. 3.

Figure 23:
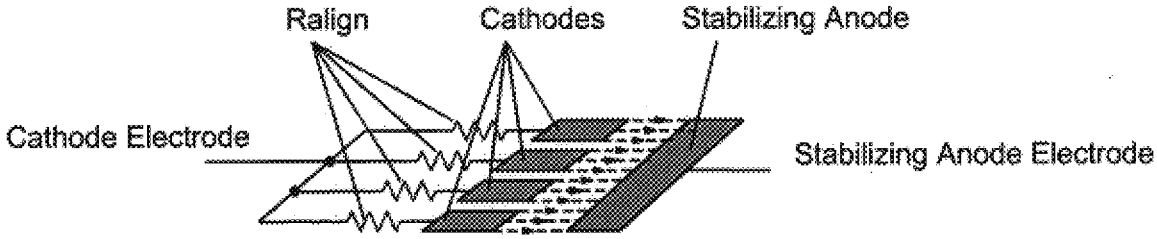
FIG. 23 is a view showing an edge emitter spatial vector electron source having multiple cathodes.

FIG. 23 is a schematic view showing an embodiment of a multiplicity-fabricated cathode of an edge emitter spatial vector electron source. The embodiment of the multiplicity fabricated cathode of the edge emitter spatial vector electron source provides an align of a field emission current of the one multiplicity fabricated cathode into one field emission device as well as a field emission current of the multiplies cathodes into different field emission devices placed on one unified substrate. Under this embodiment the each cathode into the multiplicity fabricated cathode comprises an align resistive element Realign in the cathode electrode circuit.

Figure 24:
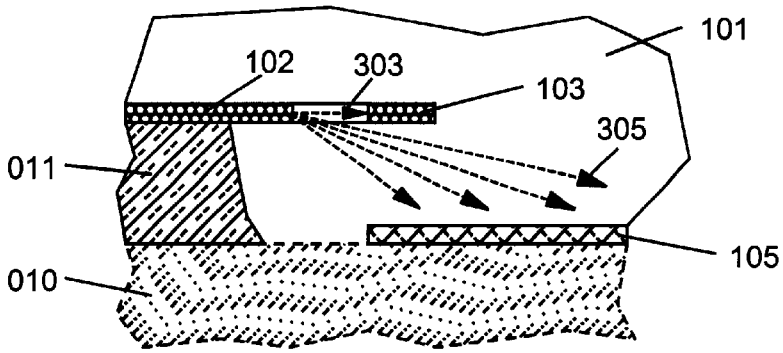
FIG. 24 is a cross section showing first embodiment of a field emission device employing an edge emitter spatial vector electron source.

FIG. 24 is a schematic sectional view showing a first embodiment of a field emission device employing an edge emitter spatial vector electron source. The first embodiment of the field emission device employing the spatial vector electron source comprises: substrate 010 that can be made from a transparent material, with deposited an collecting anode 105; a dielectric layer 011 on surface which are deposited an edge emitter cathode 102 and a stabilizing anode 103. The dielectric material 011 is thereby etched that beads of the deposited layers of conductive materials (cathodes, anodes) are protruding on certain lengths about vertical walls of the dielectric material 011.

Figure 25:
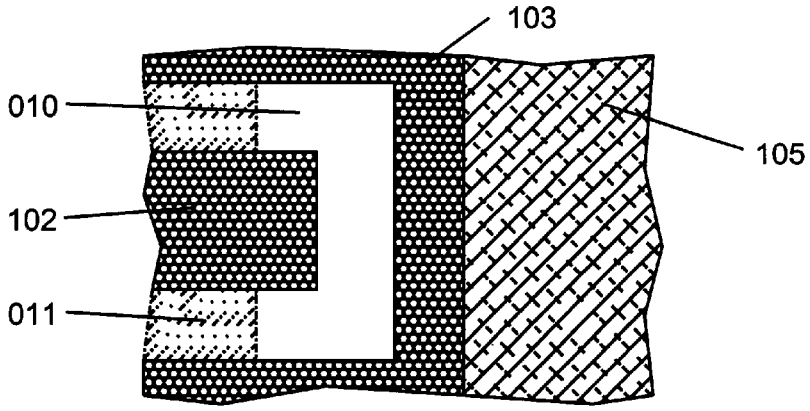
FIG. 25 is a top view of the first embodiment of the field emission device referred in FIG. 24.

FIG. 25 is a schematic sectional top view of the first embodiment, referred in FIG. 24 wherein the edge emitter cathode 102 is deposited to just the same layer as the stabilizing anode 103.

Figure 26:
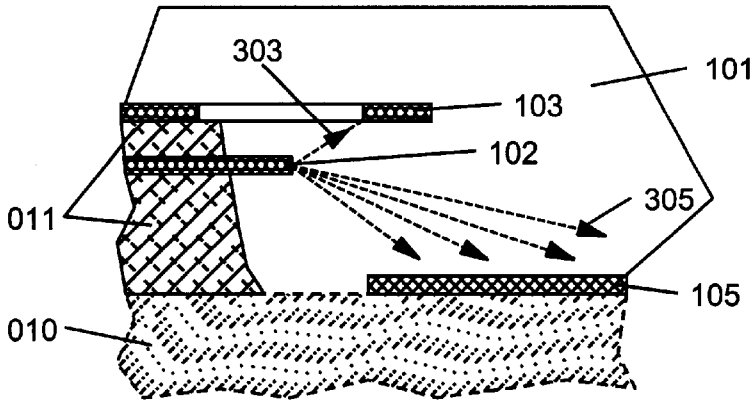
FIG. 26 is a cross section showing a second embodiment of a field emission device employing an edge emitter spatial vector electron source.

FIG. 26 is a schematic sectional view showing a second embodiment of a field emission device employing an edge emitter spatial vector electron source. The second embodiment of the field emission device employing the spatial vector electron source comprises: substrate 010 that can be made from a transparent material with deposited an collecting anode 105; two dielectric layers 011 on whose surfaces are deposited an edge emitter cathode 102 and a stabilizing anode 103 in different layers. The dielectric material 011 is thereby etched that beads of the deposited layers of conductive materials (cathodes, anodes) are protruding on certain lengths about vertical walls of the dielectric material 011.

Figure 27:
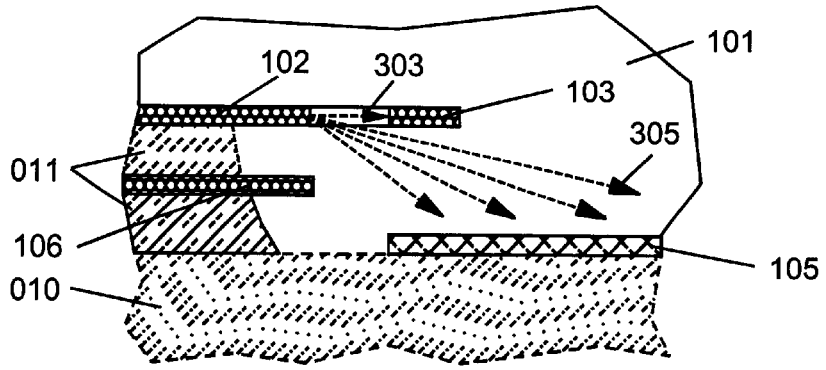
FIG. 27 is a cross section showing a third embodiment of a field emission device employing an edge emitter spatial vector electron source.

FIG. 27 is a schematic sectional view showing a third embodiment of a field emission device employing an edge emitter spatial vector electron source. The third embodiment of the field emission device employing the spatial vector electron source comprises: substrate 010 that can be made from a transparent material with deposited an collecting anode 105; a first dielectric layer 011 on surface which is deposited a control anode 106; a second dielectric layer 011 on surface which are deposited an edge emitter cathode 102 and a stabilizing anode 103. The dielectric material 011 is thereby etched that beads of the deposited layers of conductive materials (cathodes, control anodes, and anodes) are protruding on certain lengths about vertical walls of the dielectric material 011.

Figure 28:
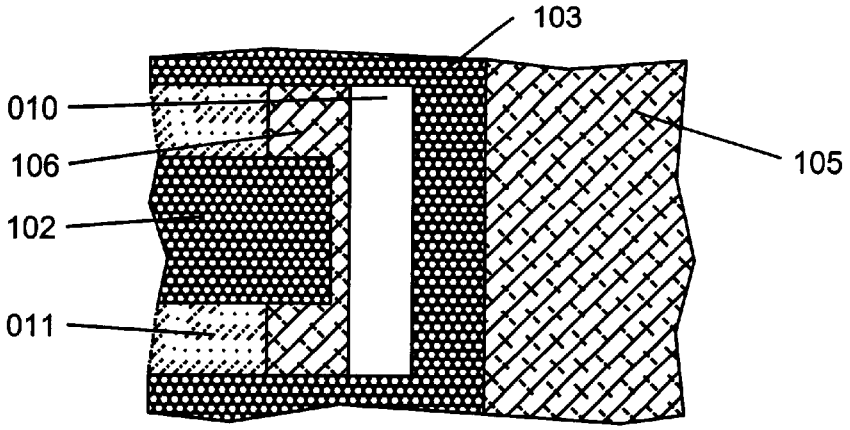
FIG. 28 is a top view of the third embodiment of the field emission device referred in FIG. 27.

FIG. 28 is a schematic sectional top view of the third embodiment, referred in FIG. 27, wherein the edge emitter cathode 102 is deposited to the same layer as the stabilizing anode 103.

Figure 29:
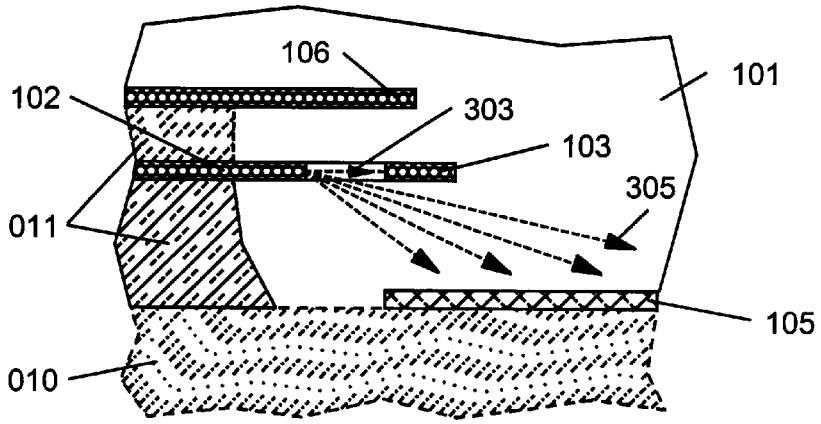
FIG. 29 is a cross section showing a forth embodiment of a field emission device employing an edge emitter spatial vector electron source.

FIG. 29 is a schematic sectional view showing a forth embodiment of a field emission device employing an edge emitter spatial vector electron source. The forth embodiment of the field emission device employing the spatial vector electron source comprises: substrate 010 that can be made from a transparent material with deposited an collecting anode 105; a first dielectric layer 011 on surface which are deposited an edge emitter cathode 102 and a stabilizing anode 103; a second dielectric layer 011 on surface which is deposited a control anode 106. The dielectric material 011 is thereby etched that beads of the deposited layers of conductive materials (cathodes, control anodes, and anodes) are protruding on certain lengths about vertical walls of the dielectric material 011.

Figure 30:
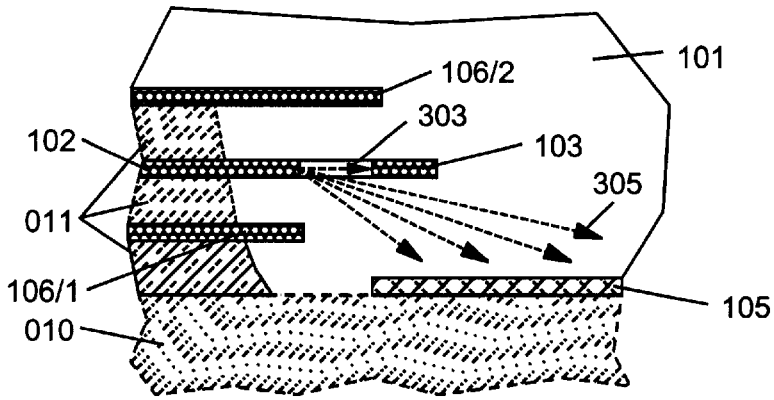
FIG. 30 is a cross section showing a fifth embodiment of a field emission device employing an edge emitter spatial vector electron source.

FIG. 30 is a schematic sectional view showing a fifth embodiment of a field emission device employing an edge emitter spatial vector electron source. The fifth embodiment of the field emission device employing the spatial vector electron source comprises: substrate 010 that can be made from a transparent material with deposited an collecting anode 105; a first dielectric layer 011 on surface which is deposited a first control anode 106/1; a second dielectric layer 011 on surface which are deposited edge emitter cathode 102 and a stabilizing anode 103; a third dielectric layer 011 on surface which is deposited a second control anode 106/2. The dielectric material 011 is thereby etched that beads of the deposited layers of conductive materials (cathodes, control anodes, and anodes) are protruding on certain lengths about vertical walls of the dielectric material 011.

Figure 31:
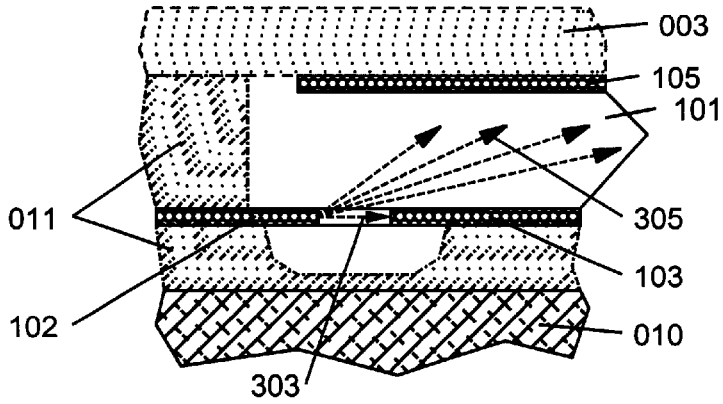
FIG. 31 is a cross section showing a sixth embodiment of a field emission device employing an edge emitter spatial vector electron source.

FIG. 31 is a schematic sectional view showing a sixth embodiment of a field emission device employing an edge emitter spatial vector electron source. The sixth embodiment of the field emission device employing the spatial vector electron source comprises: substrate 010; a first dielectric layer 011 on surface which are deposited an edge emitter cathode 102 and a stabilizing anode 103; a second dielectric layer 011 to provide a needed distance between the edge emitter cathode 102 and the collecting anode 105; a plate 003 made from a transparent material with deposited an collecting anode 105 made also from a transparent conductive material. The dielectric material 011 is thereby etched that beads of the deposited layers of conductive materials (cathodes, anodes) are protruding on certain lengths about vertical walls of the dielectric material 011.

Figure 32:
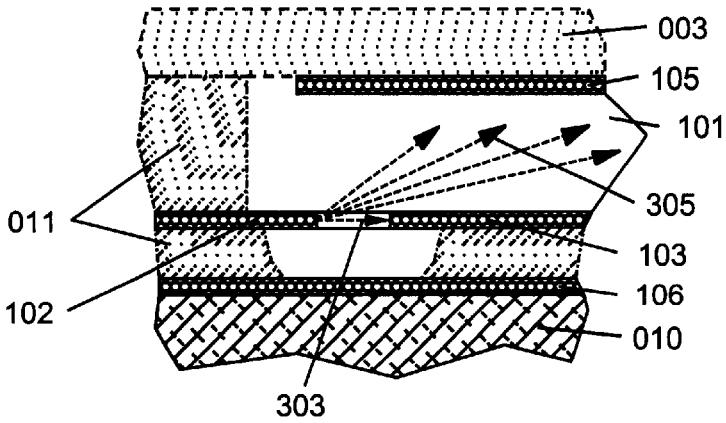
FIG. 32 is a cross section showing a seventh embodiment of a field emission device employing an edge emitter spatial vector electron source.

FIG. 32 is a schematic sectional view showing a seventh embodiment of a field emission device employing an edge emitter spatial vector electron source. The seventh embodiment of the field emission device employing the spatial vector electron source comprises: substrate 010 with deposited a control anode 106; a first dielectric layer 011 on surface which are deposited an edge emitter cathode 102 and a stabilizing anode 103; a second dielectric layer 011 to provide a needed distance between the edge emitter cathode 102 and the collecting anode 105; a plate 003 made from transparent material with deposited an collecting anode 105 made also from a transparent conductive material. The dielectric material 011 is thereby etched that beads of the deposited layers (cathodes, control anodes, and anodes) are protruding on certain lengths about vertical walls of the dielectric material 011.

Figure 33:
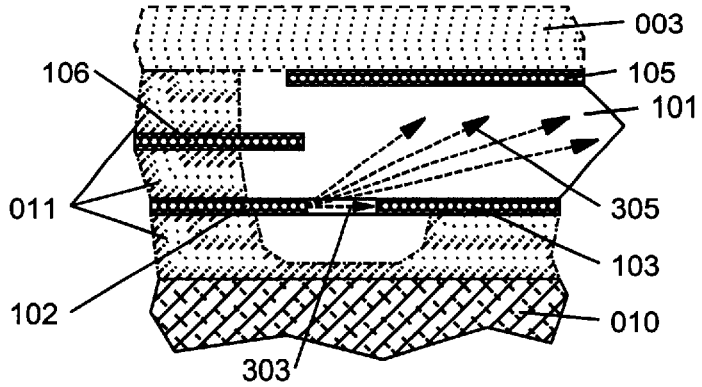
FIG. 33 is a cross section showing an eighth embodiment of a field emission device employing an edge emitter spatial vector electron source.

FIG. 33 is a schematic sectional view showing an eighth embodiment of a field emission device employing an edge emitter spatial vector electron source. The eighth embodiment of the field emission device employing the spatial vector electron source comprises: substrate 010; a first dielectric layer 011 on surface which are deposited an edge emitter cathode 102 and a stabilizing anode 103; a second dielectric layer 011 on surface which is deposited a control anode 106; a third dielectric layer 011 to provide a needed distance between the edge emitter cathode 102 and the collecting anode 105; a plate 003 made from a transparent material with deposited an collecting anode 105 made also from a transparent conductive material. The dielectric material 011 is thereby etched that beads of the deposited layers (cathodes, control anodes, and anodes) are protruding on certain lengths about vertical walls of the dielectric material 011.

Figure 34:
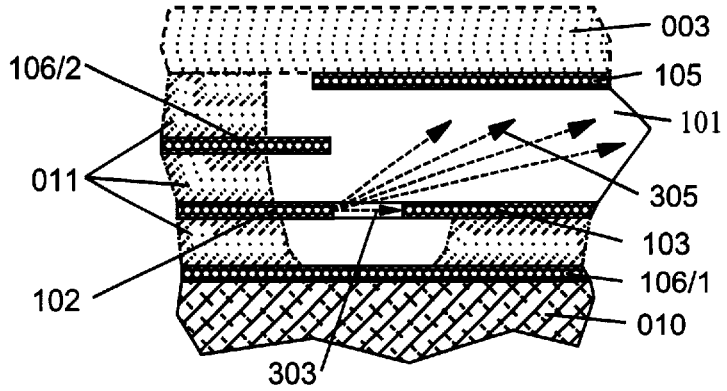
FIG. 34 is a cross section showing a ninth embodiment of a field emission device employing an edge emitter spatial vector electron source.

FIG. 34 is a schematic sectional view showing a ninth embodiment of a field emission device employing an edge emitter spatial vector electron source. The ninth embodiment of the field emission device employing the spatial vector electron source comprises: substrate 010 with deposited a control anode 106/1; a first dielectric layer 011 on surface which are deposited an edge emitter cathode 102 and an stabilizing anode 103; a second dielectric layer 011 on surface which is deposited a control anode 106/2; a third dielectric layer 011 to provide a needed distance between the edge emitter cathode 102 and the collecting anode 105; a plate 003 made from a transparent material with deposited an collecting anode 105 made also from a transparent conductive material. The dielectric material 011 is thereby etched that beads of the deposited layers (cathodes, control anodes, and anodes) are protruding on certain lengths about vertical walls of the dielectric material 011.

Figure 35:
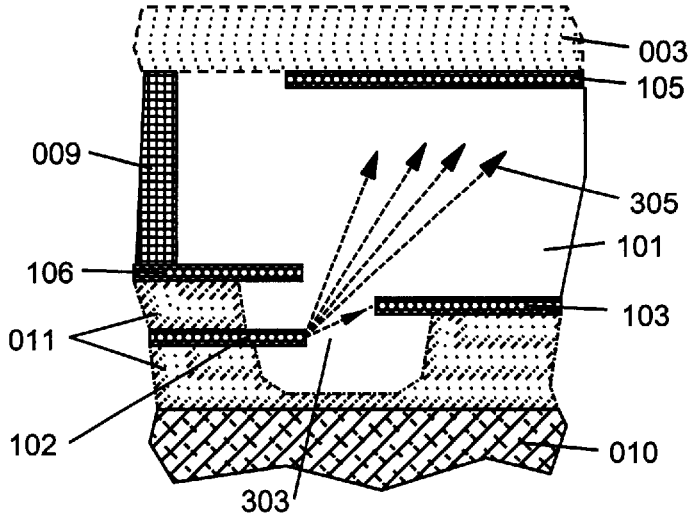
FIG. 35 is a cross section showing a tenth embodiment of a field emission device employing an edge emitter spatial vector electron source.

FIG. 35 is a schematic sectional view showing a tenth embodiment of a field emission device employing an edge emitter spatial vector electron source. The tenth embodiment of the field emission device employing the spatial vector electron source comprises: substrate 010; a first dielectric layer 011 on surface which are deposited an edge emitter cathode 102; a second dielectric layer 011 on surface which are deposited an stabilizing anode 103; a dielectric layer 011 on surface which is deposited a control anode 106; a plurality of spacers 009 for one display to provide needed space between each the edge emitter cathode 102 and the collecting anode 105; a plate 003 made from a transparent material with deposited an collecting anode 105 made also from a transparent conductive material. The dielectric material 011 is thereby etched that beads of the deposited layers (cathodes, control anodes, and anodes) are protruding on certain lengths about vertical walls of the dielectric material 011.

Figure 36:
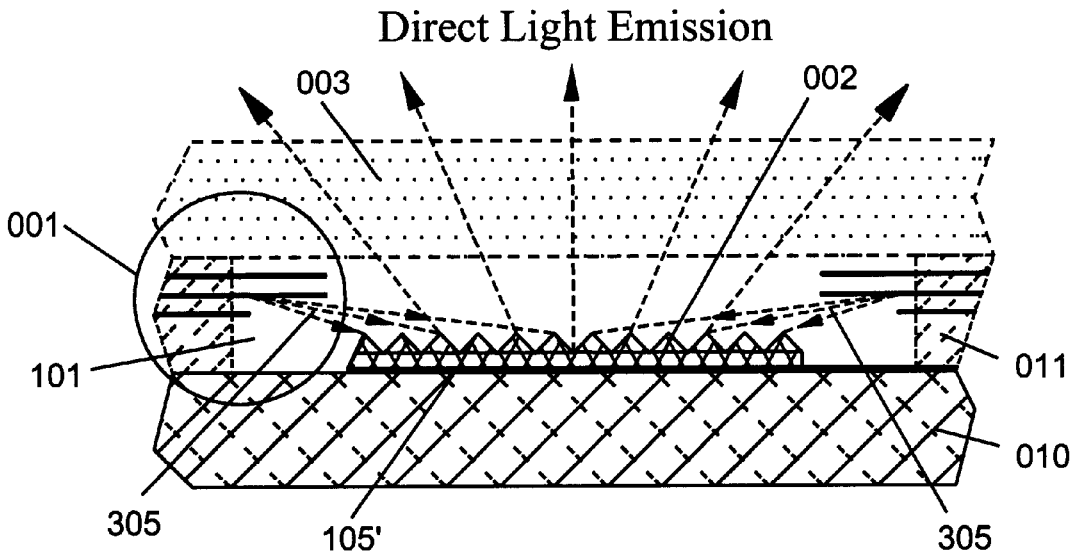
FIG. 36 is a cross section showing a first embodiment of a field emission type display apparatus employing an edge emitter spatial vector electron sources.

FIG. 36 is a schematic sectional view showing a first embodiment of a field emission flat display apparatus. The first embodiment of the flat display apparatus comprises: a substrate 010 with deposited an collecting anode 105 having on its surface an applied cathodoluminescent material 002; a plurality of field emission devices 001 employing edge emitter spatial vector electron sources that can be made by known deposition and etching processes and manners; a plate 003 made from a transparent material. Thus, this embodiment may be a monolithic display that has provided all technological procedures only for the one substrate 010. The first embodiment of the field emission display has an effective direct light emission by the cathodoluminescent material and is preferably to use with low voltage phosphors.

Figure 37:
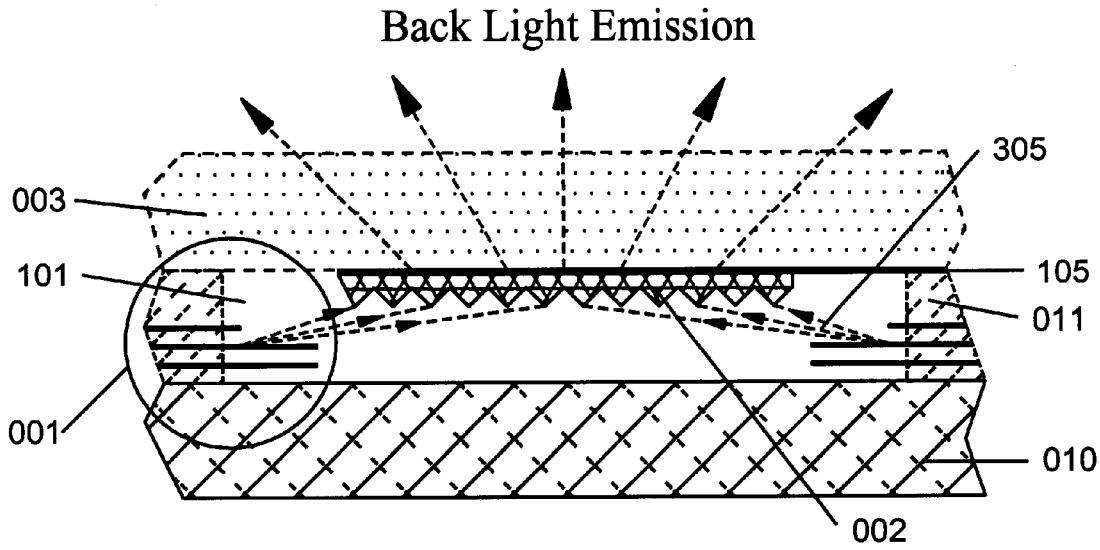
FIG. 37 is a cross section showing a second embodiment of a field emission type display apparatus employing an edge emitter spatial vector electron sources.

FIG. 37 is a schematic sectional view showing a second embodiment of a field emission flat display apparatus. The second embodiment of the flat display apparatus comprises: a substrate 010; a plurality of field emission devices employing edge emitter spatial vector electron sources 001 that can be made by known deposition and etching processes and manners; a plate 003 made from transparent material with a deposited collecting anode 105 made from a transparent conductive material having on its surface applied cathodoluminescent material 002. The second embodiment of the field emission display apparatus has a usual back light emission by the cathodoluminescent material and is preferably to use with low voltage phosphors.

Figure 38:
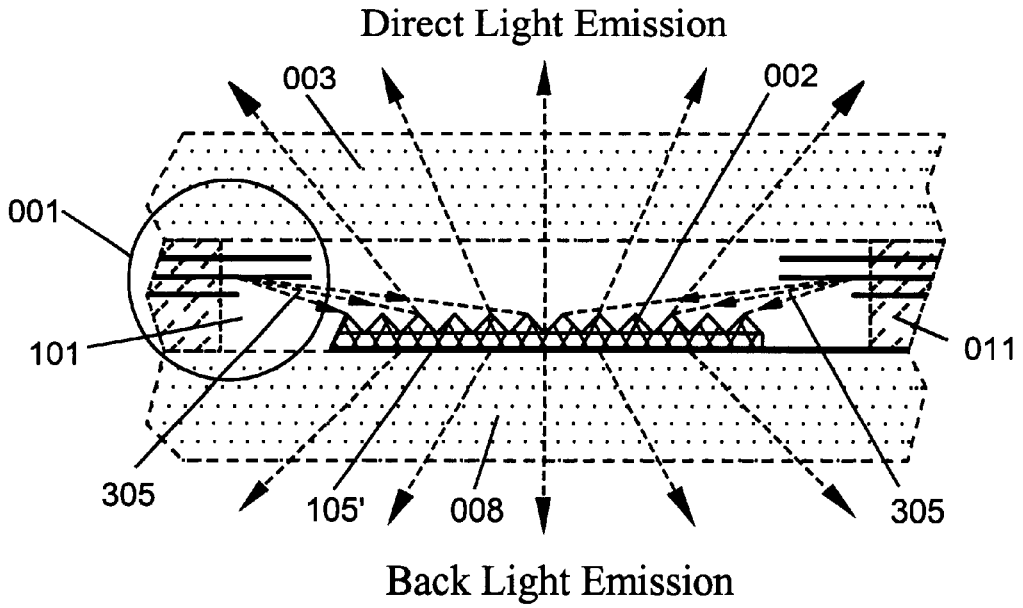
FIG. 38 is a cross section showing a third embodiment of a field emission type display apparatus employing an edge emitter spatial vector electron sources.

FIG. 38 is a schematic sectional view showing a third embodiment of a field emission flat display apparatus. The third embodiment of the flat display apparatus comprises: a substrate 008 made from transparent material with deposited an collecting anode 105 having on its surface applied cathodoluminescent material 002; a plurality of field emission devices employing edge emitter spatial vector electron sources 001 that can be made by known deposition and etching processes and manners; a plate 003 made from a transparent material. Thus, this embodiment may be a monolithic display that has provided all technological procedures only for the one substrate 010. The third embodiment of the field emission display has an effective direct light emission as well as a usual back light emission by the cathodoluminescent material and is preferably to use with low voltage phosphors.

Figure 39:
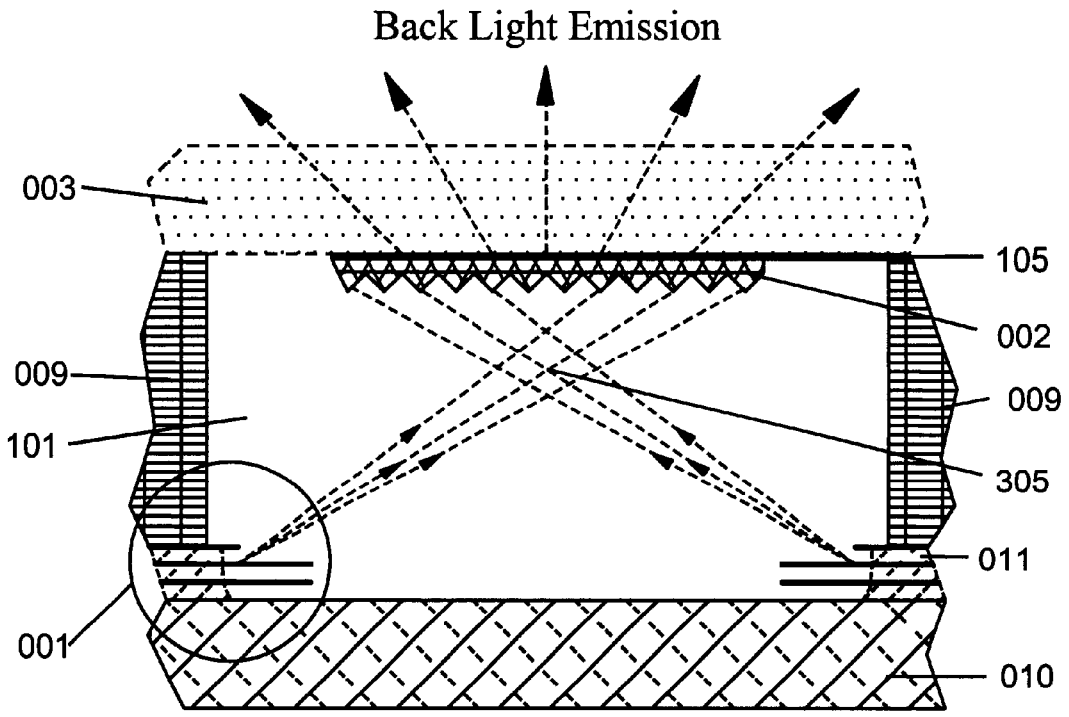
FIG. 39 is a cross section showing a fourth embodiment of a field emission type display apparatus employing an edge emitter spatial vector electron sources.

FIG. 39 is a schematic sectional view showing a forth embodiment of a field emission flat display apparatus. The forth embodiment of the flat display apparatus comprises: a substrate 010; a plurality of field emission devices employing edge emitter spatial vector electron sources that can be made by known deposition and etching processes and manners; a plate 003 made from a transparent material with a deposited collecting anode 105 made from a transparent conductive material having on his surface applied cathodoluminescent material 002; a plurality of spacers 009 to provide needed space between the edge cathodes and the collecting anode. The forth embodiment of the field emission display has a usual back light emission by the cathodoluminescent material and is preferably to use with middle and high voltage phosphors.

It is understood that many changes and additional modifications of the invention are possible in view of the teachings herein without departing the scope of the invention as defined in the appended claims.

What I claim as my invention is:

1. A field emission device comprising:

a non-stabilized spatial vector electron source comprising a field emission edge emitter cathode, a stabilizing anode and a current stabilizer in electrical circuit of said stabilizing anode;

a collecting anode;

at least one control electrode for controlling emission flow of electrons from said vector electron source to said collecting anode.

2. The field emission device of claim 1 wherein the current stabilizer of the electron source is provided by a simple resistive element.

3. A field emission device comprising:

a limited spatial vector electron source comprising a field emission edge emitter cathode, a stabilizing anode, a cathode current stabilizer in electrical circuit of said emitter cathode and an anode Current stabilizer in electrical circuit of said stabilizing anode;

a collecting anode;

at least one control electrode for controlling emission flow of electrons from said vector electron source to said collecting anode.

4. The field emission device of claim 3 wherein at least one current stabilizer of the electron source is provided by a simple resistive element.

* * * * *